US006624373B2

(12) United States Patent
Raabe et al.

(10) Patent No.: US 6,624,373 B2
(45) Date of Patent: Sep. 23, 2003

(54) ARC STACK ASSEMBLY FOR A CIRCUIT BREAKER

(75) Inventors: Rodney Raabe, Cedar Rapids, IA (US); Greg Ghere, Cedar Rapids, IA (US); Jason Colsch, Cedar Rapids, IA (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/956,220

(22) Filed: Sep. 19, 2001

(65) Prior Publication Data

US 2003/0052090 A1 Mar. 20, 2003

(51) Int. Cl.[7] ..... H01H 33/02
(52) U.S. Cl. ..... 218/149; 218/156
(58) Field of Search ..... 335/201; 218/7, 218/15, 34, 35–36, 38–39, 46–47, 149, 151, 155, 156, 157; 29/622

(56) References Cited

U.S. PATENT DOCUMENTS

| | | | | |
|---|---|---|---|---|
| 4,431,877 A | | 2/1984 | Heft et al. | |
| 4,635,011 A | | 1/1987 | Leone et al. | |
| 4,644,307 A | | 2/1987 | Tanimoto | |
| 4,716,265 A | | 12/1987 | Fujii et al. | |
| 4,791,393 A | | 12/1988 | Flick et al. | |
| 4,841,266 A | | 6/1989 | Wulff | |
| 5,220,488 A | | 6/1993 | Denes | |
| 5,440,284 A | | 8/1995 | Ferullo et al. | |
| 5,793,270 A | | 8/1998 | Beck et al. | |
| 5,898,152 A | * | 4/1999 | Kim | 218/149 |
| 5,910,760 A | | 6/1999 | Malingowski et al. | |
| 5,926,081 A | | 7/1999 | DiMarco et al. | |

FOREIGN PATENT DOCUMENTS

| | | | |
|---|---|---|---|
| DE | 2128633 | 1/1973 | H01H/77/10 |
| DE | 4404706 A1 | 9/1994 | H01H/77/10 |
| EP | 0772195 A2 | 11/1996 | G11B/21/12 |
| JP | 04-280026 | 10/1992 | H01H/71/12 |
| JP | 09-161641 | 6/1997 | H01H/73/02 |
| JP | 2000-003655 | 1/2000 | H01H/71/74 |
| WO | WO 01/16986 A1 | 3/2001 | H01H/71/50 |

OTHER PUBLICATIONS

Description of Terasaki Circuit Breaker—Te21–43, as early as 1995, 1 page.
Description of Fuji Circuit Breaker—F–9–11, as early as 1995, 2 pages.
Description of Mitsubishi Circuit Breaker—M–21–6, as early as 1995, 2 pages.
Description of Toshiba Circuit Breaker—T–9–2, as early as 1995, 1 page.
Patent Abstract for Germany—DE 4404706 A, 1 page. (see B03).

(List continued on next page.)

*Primary Examiner*—Lincoln Donovan
(74) *Attorney, Agent, or Firm*—Larry I. Golden

(57) ABSTRACT

A circuit breaker for interrupting the flow of current upon the detection of excess current or temperature is provided that contains an arc plate assembly which includes a pair of insulative mounting plates having mounted thereon a set of arc plates arranged in an arcuate array generally tracing the arcuate path of movement of a circuit breaker moveable contact blade. A baffle plate is mounted between the insulative mounting plates and positioned above the uppermost arc plate in the set of arc plates for blocking arc-formed debris from projection into the operating mechanism of said circuit breaker. Mounting tabs, which are extending toward the insulative mounting plates from edges of the arc plates, are being used to connect the mounting plates with the arc plates by passing the tabs through corresponding apertures located in the mounting plates. The tabs are crimped against the exterior surface of the mounting plates.

5 Claims, 4 Drawing Sheets

OTHER PUBLICATIONS

Patent Abstracts for Japan—Publ. No. 04–280026, Oct. 6, 1992, 1 page. (see B04).
Patent Abstracts for Japan—Publ. No. 2000–003655, Jun. 7, 2000, 1 page. (see B06).
Patent Abstract for Japan—JP 9161641 A, 1 page. (see B05).
Photographs of Terasaki Circuit Breaker—Te21–43, Photographs 1–11, 11 pages.
Photographs of Fuji Circuit Breaker—F–9–11, Photographs 12–29, 18 pages.
Photographs of Mitsubishi Circuit Breaker—M–21–6, Photographs 30–48, 19 pages.
Photographs of Toshiba Circuit Breaker—T–9–2, Photographs 49–61, 13 pages.

* cited by examiner

ARC STACK ASSEMBLY FOR A CIRCUIT BREAKER

FIELD OF THE INVENTION

This invention is directed generally to circuit breakers, and, specifically, to an arc stack for a circuit breaker.

BACKGROUND OF THE INVENTION

A circuit breaker generally contains an arc stack assembly which has the purpose of receiving and dissipating electrical arcs that are created when a movable contact separates from a stationary contact.

One particular type of arc stack includes a number of arc plates which are offset at equal distances from one another, being supported on each side by a insulating plate. The plates are generally rectangular in shape, identical to one another, and interconnected. Each plate has an arc throat that creates a path for the blade to open and to close whenever the circuit breaker is tripped and reset, respectively. The path is formed by laterally offsetting the identical arc plates relative to one another in the same direction, tracing the imaginary radius that the blade creates when opening and closing.

A drawback of this type of arc stack is that it is sometimes difficult to manufacture, particularly when dealing with circuit breakers that are relatively small in size where space is tight. Easy and reliable automated installation of the arc plates to the insulating plate would greatly increase efficiency and productivity while lowering production costs.

Another drawback typically encountered in this type of arc stack is that molten debris, which is created when the circuit breaker interrupts current, may interfere with internal components of the circuit breaker by either welding internal parts together or by jamming the operating mechanism.

Accordingly, it is an object of this invention to catch and solidify molten debris that is created when the circuit breaker interrupts current, preventing the debris from welding together internal parts of the circuit breaker or from jamming operating parts of the circuit breaker.

It is another object of this invention to make the connection for the arc plates easier and more reliable, therefore, reducing the labor required to assemble the circuit breaker.

SUMMARY OF THE INVENTION

In accordance with a preferred embodiment of the invention, an arc plate assembly for a circuit breaker is provided. It includes a pair of parallel spaced vertically oriented insulative mounting plates having mounted thereon a set of arc plates arranged in an arcuate array generally tracing the arcuate path of movement of a circuit breaker moveable contact blade. A baffle plate is mounted between the insulative mounting plates and positioned above the uppermost arc plate in the set for blocking arc-formed debris from projection into the operating mechanism of said circuit breaker The arc plate assembly baffle plate is preferably mounted at an angle such that it defines with the uppermost arc plate a wedge-shaped volume for catching and solidifying molten arc-formed debris. The baffle plate is preferably mounted at a downward inclination toward the uppermost arc plate.

In accordance with a further embodiment, an arc plate assembly is provided in which the baffle plate and said arc plates are provided with mounting tabs extending toward the insulative mounting plates. The mounting plates are provided with mounting apertures, and the mounting tabs are passed through said apertures and crimped against the exterior surfaces of said mounting plates.

According to a further preferred embodiment, an arc plate assembly for a circuit breaker is provided with a pair of parallel spaced vertically oriented mounting plates having mounted thereon a set of arc plates arranged in an arcuate array generally tracing the arcuate path of movement of a circuit breaker moveable contact blade, with the arc plates being so mounted by tabs extending through apertures in the mounting plates and being crimped against the exterior surfaces of the mounting plates. Further, in accordance with the invention, a method is provided for blocking arc-formed debris projected from the vicinity of an arc plate array in a circuit breaker toward the operating mechanism of the breaker which includes interposing a downwardly extending baffle plate at the top of the arc plate array between the array and the mechanism.

DETAILED DESCRIPTION OF THE ILLUSTRATED EMBODIMENTS

Figure 1:
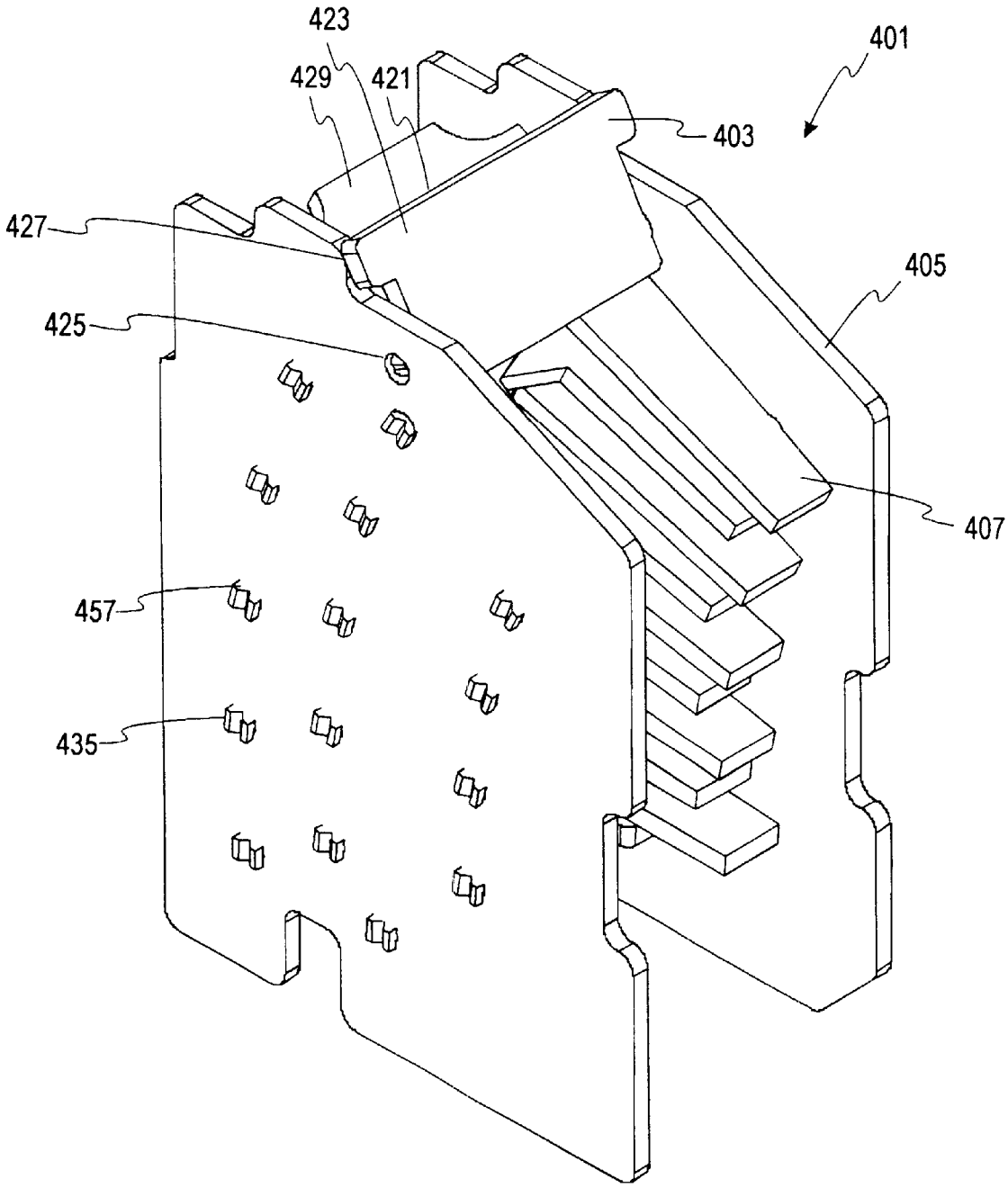
FIG. 1 is an orthogonal view of a high arc stack configuration embodying the invention.

Referring to FIG. 1, an arc stack 401 contains a baffle plate 403, an insulating plate 405 on each side of the arc stack 401, and a plurality of arc plates 407.

Figure 3A:
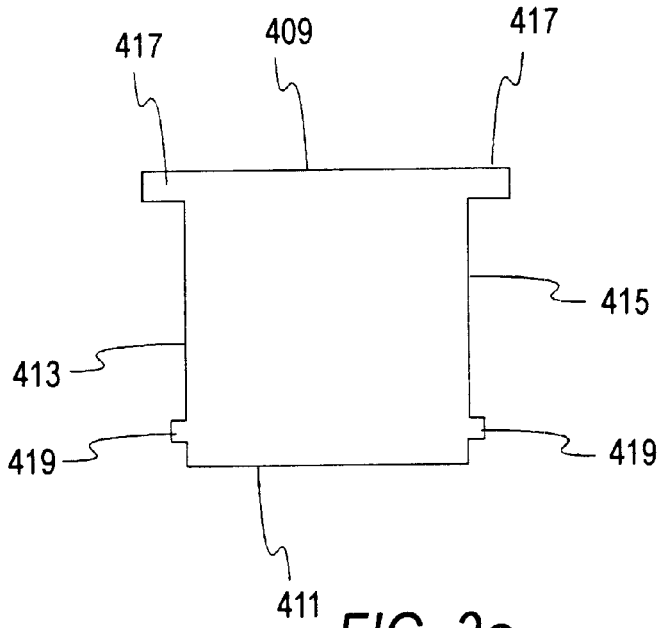
FIG. 3*a* is a front elevation of the baffle plate used in the high arc stack configuration of FIG. 1.
Figure 3B:
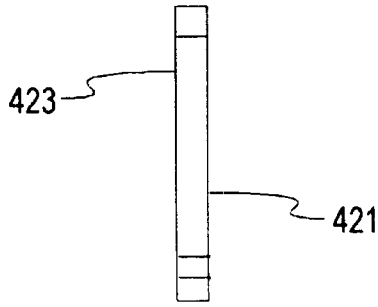
FIG. 3*b* is an end elevation of the baffle plate of FIG. 3*a;*

In a preferred embodiment, shown in FIGS. 3*a* and 3*b*, the baffle plate 403 is a generally rectangular, steel plate that has top and bottom surfaces 409 and 411, and a pair of side edges 413 and 415. A projection 417 is formed at the upper end of each side edge, and a mounting tab 419 is formed near the bottom of each side edge. The lower surface of the baffle plate 403 forms an arc surface 421, which faces the arc plates 407, while the lower surface forms a blade surface 423, which faces towards the blade (not shown) of the circuit breaker.

Each mounting tab 419 is inserted into a pivot hole 425 formed in one of the insulating plates 405 near a baffle stop 427, and each projection 417 rests its arc surface 421 against the baffle stop 427. The baffle stop 427 is positioned relative to the adjacent pivot hole 425 to allow the placement of the baffle plate 403 at an angle that forms a V-shaped space 429 between the baffle plate 403 and the uppermost arc plate 407. Specifically, the baffle plate 403 is disposed at an angle that is more than 90° in a counterclockwise direction from a horizontal plane, as viewed in FIG. 1, but not more than 180°, preferably around 120°. The V-shaped space 429 collects any molten debris that would normally fall onto and damage internal parts of the circuit breaker.

Figure 2:
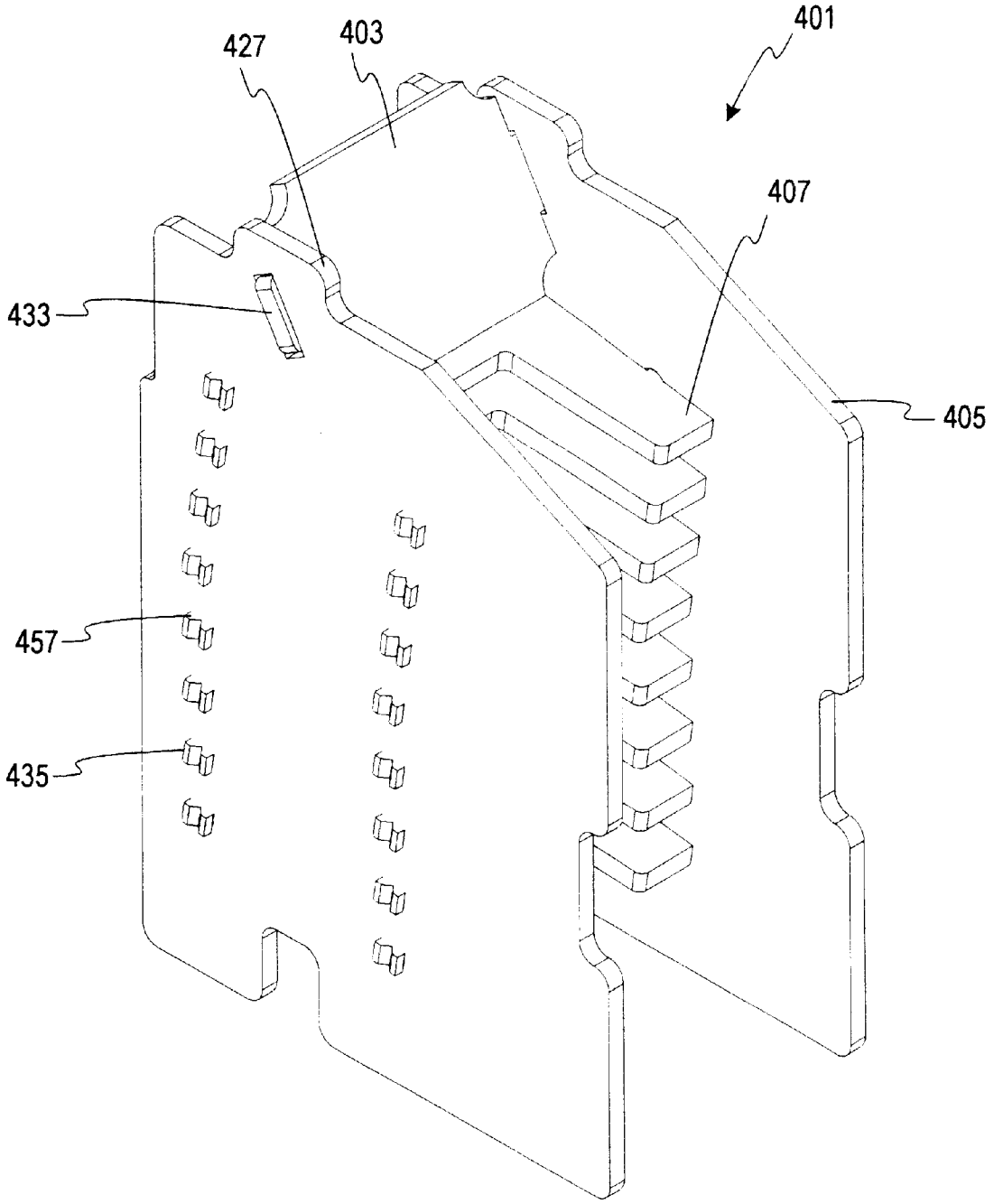
FIG. 2 is an orthogonal view of a medium arc stack configuration embodying the invention.
Figure 4:
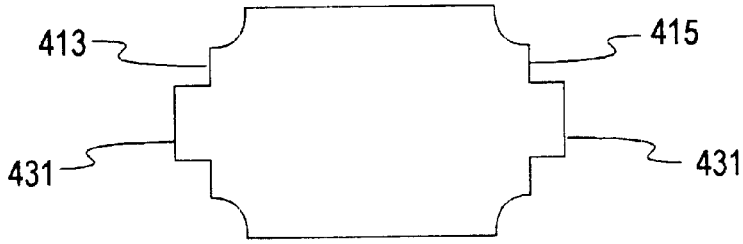
FIG. 4 is a front elevation of the baffle plate used in the medium arc stack configuration of FIG. 2.

In another preferred embodiment, shown in FIG. 2, a different method of connecting the baffle plate 403 to the insulating plate 405 is used. A mounting tab 431, clearly shown in FIG. 4, is formed in the center of each of the side edges 413 and 415. An insulating slot 433, which is located near the baffle stop 427, is shaped and dimensioned to allow the mating of the mounting tab 431 to the insulating slot 433, which, in turn, secures in place the baffle plate 403 to the insulating plate 405. In addition to provide a secure connection, the mounting of mounting tab 431 produces a V-shaped space that collects molten debris produced by arcing of the circuit breaker.

Figure 5:
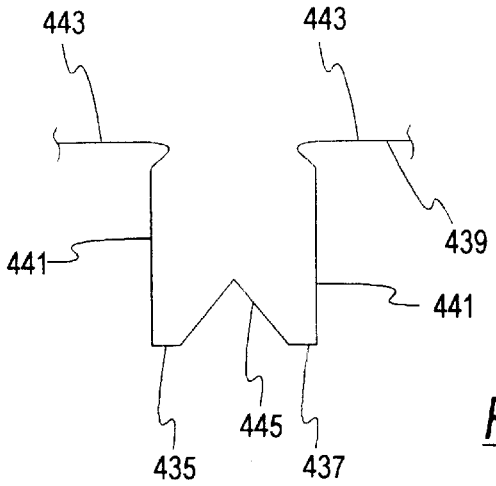
FIG. 5 is an enlarged view of one of the tabs on the baffle plate of FIG. 3*a;*

In another preferred embodiment, a crimp tab 435, clearly shown in FIG. 5, is used to easily and reliably attach the insulating plate 405 to the arc plate 407. The crimp tab 435 is a generally rectangular protrusion that has a protruding edge 437, which runs parallel to an insulating edge 439 from which it is protruding, and two extending sides 441, which run along the length of the crimp tab 435 orthogonal to the protruding edge 437. A small indentation 443 is located at the intersection of each extending side 441 with the insulating edge 439. The small indentation 443 provides a collapsing place for the material of the crimp tab 435 when the crimp tab 435 is compressed inwardly, towards the insulating edge 439, in the final assembly stage. A large indentation 445 is located in the center of the protruding edge 437, having two sides that are orthogonal to each other and forming a V-shaped contour, with the intersecting point between the two sides being centered along the length of the protruding edge 437. When the crimp tab 435 is compressed inwardly the sides of the large indentation 445 push the two corners of the crimp tab 435, which are located at the two intersections between the protruding edge 437 and the extending sides 441, resulting in a secure connection between the arc plate 407 and the insulating plate 405.

The length of the crimp tab 435 is a little longer than the thickness of the insulating plate 405, generally on the order of about one millimeter, allowing the crimp tab 435 to protrude beyond the outside surface of the insulating plate 405 before being permanently attached to the insulating plate 405. The crimp tab 435 protrudes through a tab hole 447 that is located on the insulating plate 405 and that has a diameter large enough to allow the insertion of the crimp tab 435 through the tab hole 447.

Figure 6:
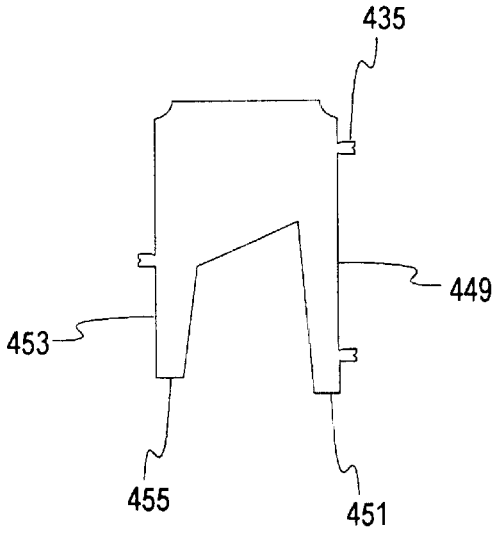
FIG. 6 is a front elevation of a modified arc plate that has three crimp tabs.

To provide a good, secure connection between the insulating plate 405 and the arc plate 407, several crimp tabs 435 may be used. For example, in the preferred embodiment shown in FIGS. 1 and 6, three crimp tabs 435 are used. On a right insulating edge 449, which is near a thick end 451, two crimp tabs 435 are located on either end of the right insulating edge 449, being generally equally spaced from the center of the edge. On a left insulating edge 453, which is near a thin end 455, one crimp tab 435 is located in the center of the edge.

Figure 7:
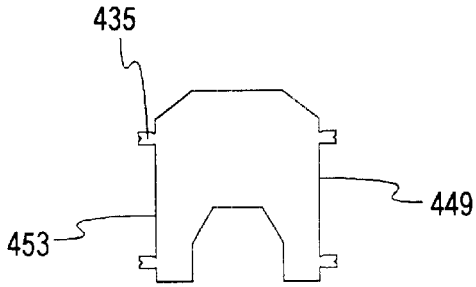
FIG. 7 is a front elevation of a modified arc plate that has four crimp tabs.

In another preferred embodiment, shown in FIGS. 2 and 7, four crimp tabs 435 are used. Two crimp tabs 435 are located on the right insulating edge 449 and two crimp tabs 435 are located on the left insulating edge 453, being equally spaced from the center of each respective edge.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A method for assembling an arc stack assembly for use in a circuit breaker, comprising:

providing a plurality of metal arc plates each having a plurality of crimp tabs extending laterally from a pair of opposite edges, each of said crimp tabs having an end cutout preformed in the free end thereof, each of said crimp tabs having a plurality of base cutouts preformed in opposite edges thereof at the base of the tab;

providing a pair of insulating support plates each of which has a plurality of apertures for receiving said crimp tabs;

mounting said arc plates on said support plates with the crimp tabs of the arc plates extending through the apertures in the support plates, and with the arc plates arranged in a spaced array between said support plates; and crimping the free ends of said crimp tabs against the adjacent portions of said support plates to attach said arc plates to said support plates.

2. The method of claim 1 wherein the crimping of said tabs produces crimped tab ends that are substantially flush with the outer surfaces of said support plates.

3. The method of claim 1 wherein the crimping of said tabs displaces metal in the tabs into said cutouts at the base of each tab and against the adjacent walls of the apertures in said support plates.

4. A method for assembling an arc stack assembly for use in a circuit breaker, comprising:

providing a plurality of metal arc plates each having a plurality of crimp tabs extending laterally from a pair of opposite edges, each of said crimp tabs having at least one cutout preformed at the base of the tab;

providing a pair of insulating support plates each of which has a plurality of apertures for receiving said crimp tabs;

mounting said arc plates on said support plates with the crimp tabs of the arc plates extending through the apertures in the support plates, and with the arc plates arranged in a spaced array between said support plates; and crimping the free ends of said crimp tabs against the adjacent portions of said support plates to attach said arc plates to said support plates, said crimping producing crimped tab ends that are substantially flush with the outer surfaces of said support plates, and said crimping displacing metal in the tabs into said cutout at the base of each tab and against the adjacent walls of the apertures in said support plates.

5. A method for assembling an arc stack assembly for use in a circuit breaker, comprising:

providing a plurality of metal arc plates each having a plurality of crimp tabs extending laterally from a pair of opposite edges, each of said crimp tabs having cutouts preformed in opposite edges thereof at the base of the tab;

providing a pair of insulating support plates each of which has a plurality of apertures for receiving said crimp tabs;

mounting said arc plates on said support plates with the crimp tabs of the arc plates extending through the apertures in the support plates, and with the arc plates arranged in a spaced array between said support plates; and crimping the free ends of said crimp tabs against the adjacent portions of said support plates to attach said arc plates to said support plates.

* * * * *